United States Patent [19]

Stevens

[11] 4,248,461

[45] Feb. 3, 1981

[54] SLIDING DOOR LOCKING APPARATUS

[76] Inventor: C. Jim Stevens, 8702 W. Morris St., Indianapolis, Ind. 46231

[21] Appl. No.: 22,939

[22] Filed: Mar. 22, 1979

[51] Int. Cl.[3] ..... E05C 3/14

[52] U.S. Cl. ..... 292/218; 292/DIG. 46; 292/265

[58] Field of Search ..... 292/DIG. 15, DIG. 46, 292/94, 265, 213, 218, 305, 342; 70/DIG. 49

[56] References Cited

U.S. PATENT DOCUMENTS

| | | | |
|---|---|---|---|
| 157,452 | 12/1874 | Kinney | 292/265 |
| 533,660 | 2/1895 | Mitchell | 292/305 |
| 570,007 | 10/1896 | Dalton . | |
| 964,283 | 7/1910 | Link | 292/DIG. 15 |
| 1,460,614 | 7/1923 | Smith, Jr. | 292/213 |
| 1,594,295 | 7/1926 | Donovan | 292/DIG. 46 |
| 2,448,748 | 9/1948 | Vanderveld | 292/DIG. 46 |
| 3,083,045 | 3/1963 | Linderoth | 292/DIG. 46 |
| 3,352,586 | 11/1967 | Hakanson | 292/225 |
| 4,068,872 | 1/1978 | Smith | 292/87 |

FOREIGN PATENT DOCUMENTS

| | | | |
|---|---|---|---|
| 557509 | 5/1958 | Canada | 70/DIG. 49 |
| 868209 | 5/1961 | United Kingdom . | |

*Primary Examiner*—Richard E. Moore

*Attorney, Agent, or Firm*—Woodard, Weikart, Emhardt & Naughton

[57] ABSTRACT

A sliding door locking apparatus in which ratchet shaped catches project vertically from a housing and are depressible to a lowered position. The housing is horizontally mounted to the base of the door frame. One of the catches prevents the opening of the door by making contact with a blocking member that is attached to the slidable door panel. However, the door can be quickly closed because contact between the blocking member and the catch in the opposite direction depresses the catch, owing to its ratchet shape. When the catch is depressed to a lower position, the door can move freely in either direction. An alarm is provided which is responsive to an attempt to open the door when the catch is not depressed to a lowered position.

6 Claims, 4 Drawing Figures

SLIDING DOOR LOCKING APPARATUS

BACKGROUND OF THE INVENTION

The field of the invention is locking devices for sliding doors.

The use of sliding glass doors is widespread in our country today. Many modern apartment buildings incorporate sliding glass doors which open out onto patios and balconies. Such doors are also commonly used in houses. However, there is a major setback with these particular doors in that they are susceptible to forced entry. Most of the doors manufactured today are built with simple latch locks which can be easily popped open when a sufficient force is applied against them. Additionally, there are simple burglarly techniques which can easily open the locks. It is therefore very desirable to have available a reliable locking device which can be mounted to a sliding glass door.

A common method of locking a sliding glass door in a closed position is to prop a brace (typically a two by two piece of wood) along the sliding guide of the frame, between the slidable door panel and the stationary surrounding frame portion of the door. However, such braces are still prone to popping out of position when sufficient force is applied to the door. These braces are also somewhat inconvenient in that they must be removed and inserted every time a person wishes to unlock or lock the sliding door and this involves crouching to the floor each time to do so. This may be especially difficult for elderly people. Also, if the brace is not properly positioned (for instance, being improperly set at an angle) it can be more easily popped out of position.

U. S. Pat. No. 3,352,586 issued to Hakanson discloses a lock device for a sliding door. In Hakanson a pivotable locking member with a pull chain is mounted on the upper central portion of the door. By pulling and releasing the chain the locking member disengages and engages with teeth which are set in fixed position along the upper edge of the door frame. When the locking member is engaged, movement is prevented in either direction. There are several disadvantages with the Hakanson device. For example, the door cannot be quickly closed when the lock is engaged because the chain must first be pulled down in order to move the door. Because the locking device is in the upper central portion of the door it is clearly exposed to view and therefore tends to destroy the aesthetic effect of the sliding glass door. Also a person who wishes to move the location of the slidable door panel must reach across the width of the panel to reach the pull chain. This is an awkward maneuver to accomplish and may be particularly difficult for the elderly, especially those having an arthritic condition. Another disadvantage with the Hakansonlock is that the pull chain may be unable to be reached by small children, and would thus pose a problem to quick exit, such as when a fire occurs and the front door is unable to be used.

Other prior art, although not specifically relating to the present invention, includes: U.S. Pat. No. 4,068,872 issued to Smith which discloses a toe operated latch used for locking a cabinet door; U.S. Pat. No. 570,007 issued to Dalton which discloses a window-sash lock utilizing a ratchet shaped rack-bar secured to the window frame and a sliding lock-bolt which secures the window in a desired position; and British Pat. No. 868,209 to Newman et al disclosing a double door that incorporates a locking device within it.

SUMMARY OF THE INVENTION

In general terms the present invention is a sliding door lock in which a housing is horizontally mounted to the base of the door frame. A catch vertically protrudes above the housing and is depressible to a lowered position. A blocking member is attached to the sliding door panel such that when an attempt is made to open the door with the catch in its normally raised position, the blocking member and the catch make contact with each other to prevent the opening of the door.

Certain features incorporated in the present invention include a catch having a ratchet shape which allows for the easy closing of the slidable door panel without the need for manually depressing the catch bar. Another feature of the present involves includes having several catches spaced along the catch bar such that the door may be set partially open (for instance to allow ventilation) yet further opening of the door is prevented. Another feature is an alarm which is responsive to an axial force applied to the bar, thus indicating when an attempt is being made to open the door without unlocking the device.

It is therefore an object of the present invention to provide an improved locking device for a sliding door.

Other objects and advantages of the present invention will become more apparent from the following figures and detailed description.

DESCRIPTION OF THE PREFERRED EMBODIMENT

Figure 1:
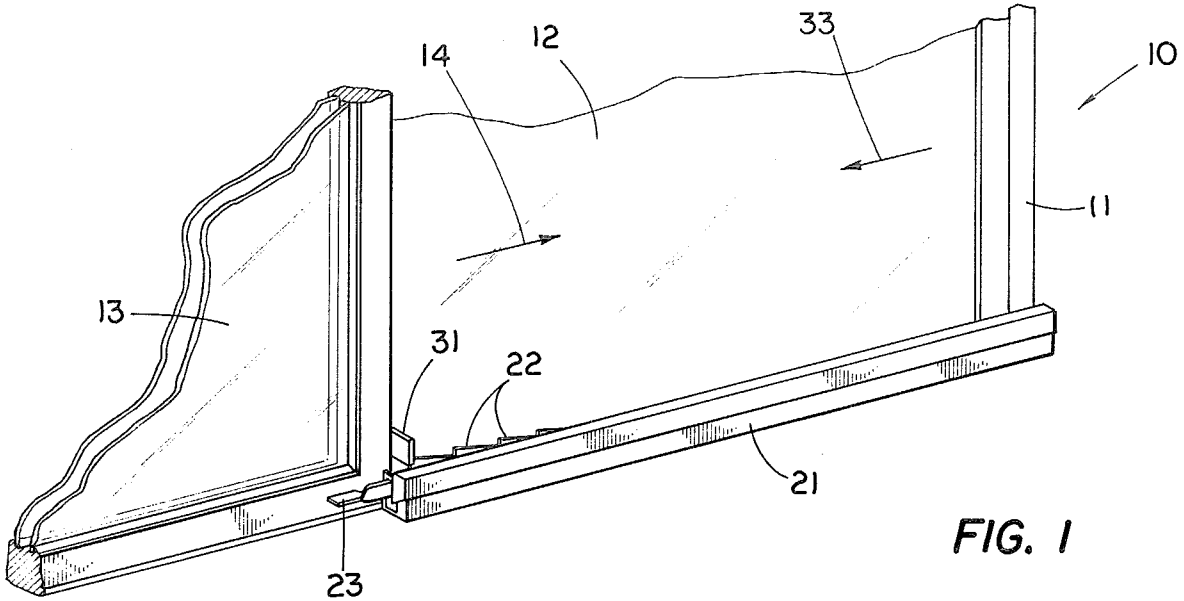
FIG. 1 is a partial perspective view of a sliding glass door with the preferred embodiment of a door lock according to the present invention mounted to it.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1, there is illustrated an elongated box-shaped housing 21 which is horizontally mounted to the base of frame 11 of sliding glass door 10. Sliding glass door 10 has a stationary panel 12 and a slidable door panel 13 in a closed position and which is movable in the direction of arrow 14 to a fully opened position. Mounted to the lower portion of slidable door panel 13 and extending outwardly therefrom in a substantially horizntal direction is blocking member 31. Projecting upwardly from housing 21 are four ratchet shaped catches 22 which collectively have a sawtooth appearance. Also shown in FIG. 1 is a pedal 23 outwardly projecting from the end of housing 21 in a horizontal direction.

Figure 2:
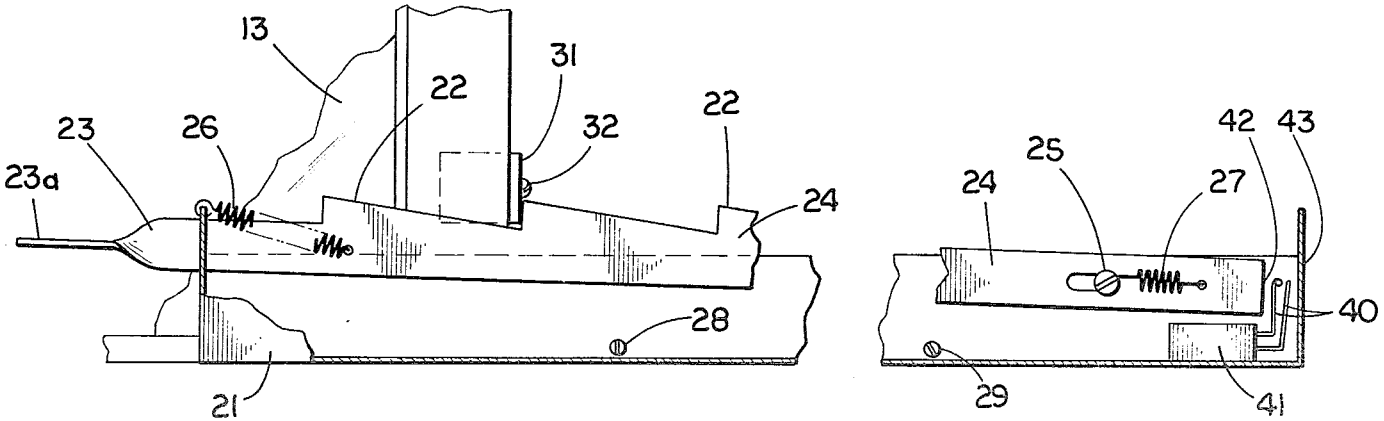
FIG. 2 is a partial, fragmentary front elevation view of the FIG. 1 door lock with a catch bar in a raised position.

FIG. 2 is a front elevation view of housing 21 illustrating its internal structure. Catches 22 are a part of catch bar 24, projecting upwardly on it. Catch bar 24 is pivotally mounted to housing 21 by pivot pin 25. Catch bar 24 also includes pedal 23 which projects out of one end of housing 21. Pedal 23 has a flat, horizontal surface 23*a* portion which is suitably sized and positioned for depression by the toe portion of a foot or shoe. Spring 26 is mounted to housing 21 and to catch bar 24 and maintains catch bar 24 in a normally raised position. Also included are bolts 28 and 29 which fasten housing 21 to door frame 11.

Blocking member 31 is fastened to slidable door panel 13 by bolt 32. In FIG. 2, catch bar 24 is in a normally raised position with blocking member 31 making contact with one of catches 22. The effect is that slidable door panel 13 is prevented from further movement in the direction of arrow 14. However, because of the ratcheted, sawtooth shape of catches 22, slidable door panel 13 may be quickly closed from an open position even though catch bar 24 is in this normally raised position. This result is possible because of the absence of any restricting structures to the free movement of door panel 13 in the direction of arrow 33. The pressure on catch bar 24 from blocking member 31 when slidable door panel is being closed depresses catch bar 24 momentarily and thus slidable door panel 13 is allowed to pass.

Electrical contacts 40 are connected to a warning device which in the exemplary embodiment is alarm 41. Spring 27 is mounted to pivot pin 25 and catch bar 24. If an axial force is applied to catch bar 24 (by blocking member 31 pressing against catch 22 for instance) then bar 24 is able to move toward contacts 40. Springs 26 and 27 resist this movement; however, if sufficient axial force is applied then contacts 40 close completing an electrical circuit which includes alarm 41. This closure initiates an audial alarm signal from alarm 41 and acts as a warning of an attempted forced entry. The distance between end 42 of catch bar 24 and wall 43 of housing 21 is quite small and this prevents door panel 13 from being opened to a sufficient degree to enable an intruder to release pedal 23.

Figure 3:
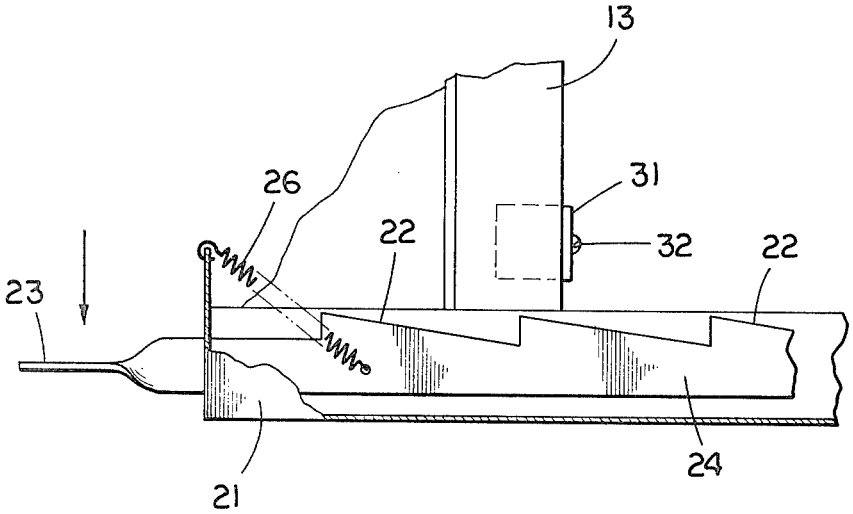
FIG. 3 is a partial, fragmentary front elevation view of the FIG. 1 door lock with the catch bar in a lowered position.
Figure 4:
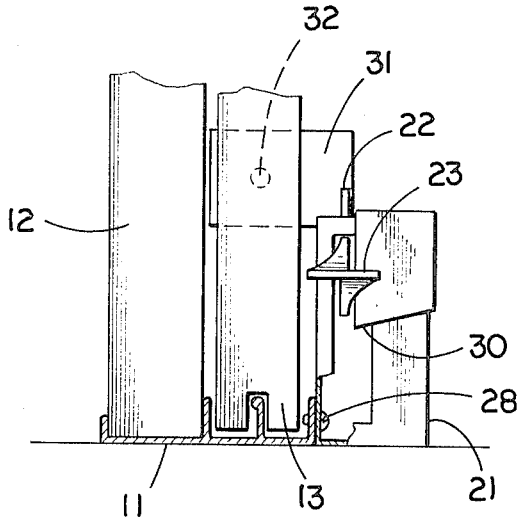
FIG. 4 is a fragmentary side elevation view of the preferred embodiment as shown in FIGS. 1–3.

Referring to FIG. 3, catch bar 24 is in a lowered position. In this position, catches 22 do not make contact with blocking member 31 when slidable door panel 13 is moved along housing 21. Therefore, slidable door panel 13 is free to move in either direction. When catch bar 24 is in this lowered position spring 26 is resiliently stretched and therefore urges catch bar 24 to return to its normally raised position. Catch bar 24 may be maintained in the lowered position by either maintaining pressure upon pedal 23 or by latching the vertical portion of pedal 23 beneath the depending edge of latch 30. Latch 30 can be seen in FIG. 4 and is located at the end of housing 21 through which catch bar 24 passes. When pedal 23 is depressed catch bar 24 may be moved laterally into position underneath latch 30 and catch bar 24 can thereby be maintained in a lowered position. Latch 30 is angularly oriented and over hangs the lower portion of housing 21 in order to avoid accidentally unlatching of catch bar 24. FIG. 4 also more clearly illustrates the manner in which housing 21 is mounted to the base of door frame 11, showing bolt 28 fastened to frame 11.

There are four ratchet shaped catches 22 in the preferred embodiment, spaced 3 inches apart. The additional catches allow slidable door panel 13 to be partially opened, and yet be prevented from further opening. Thus slidable door panel 13 can be opened 3, 6 or 9 inches (to allow ventilation for instance) but is prevented from further opening when the catch bar is in a normally raised position.

There are various alternative designs other than the described preferred embodiment that would still be within the spirit of the invention. For instance, the alarm could produce a visual signal as well as an audible alarm, or it could be connected to a general burglary detection system. Also the location of the pedal could be changed, or the spring mechanism for maintaining the position of the catch bar could be varied. Therefore, while there have been described above the principles of this invention in connection with specific apparatus, it is to be clearly understood that this description is made only by way of example and not as a limitation to the scope of the invention.

What is claimed is:

1. A lock, in combination with a sliding door, said door having a door frame and a slidable door panel movable between a closed position and a fully opened position, said lock comprising:

(a) a housing member mounted to the base of the door frame;

(b) catch means pivotally attached to said housing, said catch means being disposed in a normally raised position and including a plurality of catches which project vertically upward;

(c) depression means for depressing said catch means to a lowered position;

(d) a blocking member mounted to the slidable door panel and arranged such that said blocking member makes contact with one of said plurality of catches when said catch means is in the normally raised position and said door panel is in said closed position thereby preventing movement of the slidable door panel from a closed position to a fully opened position;

(e) a horizontally flat pedal portion secured to one end of said catch bar;

(f) a spring connecting said catch bar to said housing, said spring urging said catch bar toward said normally raised position; and (g) alarm means responsive to an axial force applied to said catch bar, such that if a sufficient axial force is applied to said catch bar, said alarm means produces an alarm signal.

2. The lock of claim 1 in which said catch means includes a catch bar having a plurality of catches said plurality of catches having a sawtooth shape such that when the slidable door panel is opened and said catch bar is in said normally raised position, contact between said blocking member and said catch bar as said sliding door panel is moved to said closed position depresses said catch bar to said lowered position.

3. The lock of claim 1 wherein said plurality of said catches includes four catches on three inch spacing.

4. A lock, in combination with a sliding door, said door having a door frame and a slidable door panel movable between a closed position and a fully opened position, said lock comprising:

(a) a housing member mounted to the base of the door frame;

(b) catch means pivotally attached to said housing, said catch means being disposed in a normally raised position and including a plurality of catches which project vertically upward;

(c) depression means for depressing said catch means to a lowered position; said depression means including (i) pedal means attached to one end of said catch bar, for depressing said catch bar;

(ii) spring means for biasing said catch bar in a normally raised position and for resiliently returning said catch to its normally raised position when any depressing force is removed from said pedal means; and (iii) latch means for maintaining said catch bar in said lowered position;

(d) a blocking member mounted to the slidable door panel and arranged such that said blocking member makes contact with one of said plurality of catches when said catch means is in the normally raised position and said door panel is in said closed position thereby preventing movement of the slidable door panel from a closed position to a fully opened position.

5. A lock, in combination with a sliding door, said door having a door frame and a slidable door panel movable between a closed position and a fully opened position, said lock comprising:

(a) a housing member secured to the base of said door frame in a substantially horizontal orientation;

(b) a blocking member secured to said slidable door panel and extending outwardly therefrom in a direction toward said housing member;

(c) a catch bar pivotally attached to said housing member and movable between a normally raised position and a depressed position, said catch bar including at least one catch which engages said blocking member when said sliding door is in said closed position; and (d) alarm means disposed between one end of said catch bar and said housing member operatively arranged for signaling attempted forced opening of said sliding door.

6. The lock of claim 5 wherein said catch bar includes four catches located on 3 inch centers.

* * * * *